US006435886B2

(12) United States Patent
Oguma

(10) Patent No.: US 6,435,886 B2
(45) Date of Patent: Aug. 20, 2002

(54) ROTARY CONNECTOR CAPABLE OF LARGELY INCREASING HEIGHT OF SPACE ACCOMMODATING FLEXIBLE CABLE

(75) Inventor: Takashi Oguma, Miyagi-ken (JP)

(73) Assignee: Alps Electric Co., LTD, Tokyo (JP)

( * ) Notice: Subject to any disclaimer, the term of this patent is extended or adjusted under 35 U.S.C. 154(b) by 0 days.

(21) Appl. No.: 09/918,237

(22) Filed: Jul. 30, 2001

(30) Foreign Application Priority Data

Aug. 9, 2000 (JP) ..... 2000-247921

(51) Int. Cl.[7] ..... H01R 3/00
(52) U.S. Cl. ..... 439/164; 439/15
(58) Field of Search ..... 439/164, 15

(56) References Cited

U.S. PATENT DOCUMENTS 5,137,463 A * 8/1992 Sasaki et al. ..... 439/164
5,871,367 A * 2/1999 Ichikawa et al. ..... 439/164
5,904,585 A * 5/1999 Nishikigi et al. ..... 439/164
5,975,931 A 11/1999 Ishikawa
6,224,406 B1 * 5/2001 Takahashi et al. ..... 439/164
6,264,487 B1 * 7/2001 Taniuchi et al. ..... 439/164

* cited by examiner

*Primary Examiner*—Brian Sircus
*Assistant Examiner*—Son V. Nguyen
(74) *Attorney, Agent, or Firm*—Brinks Hofer Gilson & Lione

(57) ABSTRACT

The present invention realizes a rotary connector which can largely set the height of an accommodating space for a flexible cable of the rotary connector. The rotary connector includes a movable housing comprised of a first rotor member and a second rotor member, a fixed housing having a cover, a flexible cable and a control member. The second rotor member includes an annular holding member which is protruded radially. The cover includes an annular wall portion and a bent portion which is contiguously connected to an inner peripheral end portion of the wall portion which is formed by bending toward the inside of the housing. The control member includes an annular base portion. The holding portion is arranged outside the bent portion. In the state that the bent portion and the holding portion are axially overlapped to each other, the fixed housing is latched by the movable housing and simultaneously an inner peripheral end portion of the base portion which is arranged at the inside of the wall portion is arranged such that the inner peripheral end portion and the bent portion do not overlap each other in the axial direction.

10 Claims, 3 Drawing Sheets

ROTARY CONNECTOR CAPABLE OF LARGELY INCREASING HEIGHT OF SPACE ACCOMMODATING FLEXIBLE CABLE

BACKGROUND OF THE INVENTION

1. Field of the Invention

The present invention relates to a rotary connector which is mounted on a steering shaft of an automobile or the like and performs an electric connection between electric devices provided to a steering wheel and a car body respectively.

2. Description of the Prior Art

Conventionally, there has been proposed a rotary connector which electrically connects an electric device provided to a steering wheel with an electric device provided to a car body.

This rotary connector enables the electric connection between the electric device which is provided to the steering wheel which constitutes a rotary body and the electric device which is provided to the car body which constitutes a fixed body. The rotary connector accommodates a flexible electric cable or an optical fiber cable (these are generally referred to as "flexible cable" hereinafter) in a wound form between a rotor portion which is rotatably driven by the steering wheel and a case which constitutes a stator portion. The flexible cable has one end thereof fixedly secured to the rotor portion and the other end thereof fixedly secured to the stator portion. Due to such a constitution, the rotary connector enables the electric connection between respective electric devices by making use of the reeling and unreeling of the flexible cable.

A conventional rotary connector is explained in conjunction with attached drawings.

FIG. 4 is a cross-sectional view showing the conventional rotary connector and FIG. 5 is an enlarged cross-sectional view of a portion B of FIG. 4.

As shown in FIG. 4, this rotary connector 100 is generally comprised of a pair of upper-side first rotor member 11 and a lower-side second rotor member 12 which are concentrically and rotatably connected to each other, a cable accommodating portion 13, rollers 14, a roller holder 15, a lower cover 16, and a flexible cable 17 which is accommodated and wound in the inside of a space defined by the first and second rotor member 11, 12, the cable accommodating portion 13 and the cover 16.

Here, the first rotor member 11 and the second rotor member 12 are united to form a movable housing, while the cable accommodating portion 13 and the cover 16 are united to form a fixed housing. Further, they are constituted such that when the movable-side housing is rotated in the clockwise direction or counter clockwise direction, the winding of the flexible cable 17 in the space is tightened or loosened.

In the rotary connector 100 having such a general constitution, the fixed-side housing is fixedly secured to a car body (not shown in the drawing) and the movable-side housing is fixedly secured to a hub (not shown in the drawing) of a steering shaft. At the same time, by connecting both ends of the flexible cable 17 respectively to electric devices at the car body side and the steering wheel side by way of respective connectors (not shown in the drawing), the rotary connector 100 can be used as electric connection means of an airbag system, a horn circuit or the like mounted on a vehicle.

Further, the first rotor member 11 includes a cylindrical portion 11*a* having an approximately circular cylindrical shape and an annular notched portion 11*b* which is formed in an outer peripheral portion of one end of the cylindrical portion 11*a*.

The second rotor member 12 includes a large-diameter cylindrical portion 12*a* having an approximately circular cylindrical shape, an intermediate-diameter cylindrical portion 12*b* which is contiguously connected to the large-diameter cylindrical portion 12*a*, a small-diameter cylindrical portion 12*c* which is contiguously connected to the intermediate-diameter cylindrical portion 12*b*, and an annular holding portion 12*d* which is formed perpendicularly in the radial direction from a joining portion of the large-diameter cylindrical portion 12*a* and the intermediate-diameter cylindrical portion 12*b*.

This large-diameter cylindrical portion 12*a* of the second rotor member 12 is made to pass through the cylindrical portion 11a of the first rotor member 11 and the second rotor member 12 is engaged with the first rotor member 11 by means of a suitable means such as a snap-in joint, for example. Then, by arranging an upper surface of the holding portion 12*d* of the second rotor member 12 and the notched portion 11*b* of the first rotor member 11 such that they are brought into contact with each other, a groove-like space portion 11*c* is formed.

The cable accommodating portion 13 includes an annular side wall 13*a* and has both end portions opened.

The roller holder 15 includes a planar annular base portion 15*a* and a plurality of roller supporting portions 15*b* which are perpendicularly and outwardly protruding from the base portion 15*a*. This roller holder 15 is arranged in the inside of the cable accommodating portion 13. Further, the roller holder 15 makes a portion of the inner peripheral side of the base portion 15*a* thereof arranged in the inside of the abovementioned space portion 11*c*.

The cover 16 includes an approximately planar annular wall portion 16*a*, a side wall 16*b* which is perpendicularly formed on the outer peripheral portion of the wall portion 16*a*, and a stepped portion 16*c* which is protruded in an L-shaped cross section inwardly from the inner peripheral portion of the wall portion 16*a*. Further, the side wall 13*a* of the cable accommodating portion 13 is engaged with the side wall 16*b* of the cover 16 by a suitable means such as a snap-in joint, for example, so that the cable accommodating portion 13 and the cover 16 are united to form the fixed housing.

Further, the cover 16 makes a portion of the inner peripheral side of the stepped portion 16*c* thereof arranged in the inside of the abovementioned space portion 11*c*. The portion of the inner peripheral side of the abovementioned base portion 15*a* of the abovementioned roller holder 15 and the stepped portion 16*c* of the cover 16 are laminated to each other and are arranged in a loose state with a play.

Here, the portion of the inner peripheral side of the base portion 15*a*, the stepped portion 16*c* and the holding portion 12*d* are arranged such that they face the notched portion 11*b* of the first rotor member 11 in an opposed manner, while the portion of the inner peripheral side of the base portion 15*a* and the stepped portion 16*c* are arranged in the inside of the notched portion 11*b*. In this manner, the portion of the inner peripheral side of the base portion 15*a*, the stepped portion 16*c* and the holding portion 12*d* are laminated and arranged in three layers. Then, an outer surface of the holding portion 12*d* and an outer surface of the wall portion 16*a* of the cover 16 are arranged on an approximately coplanar plane. In this state, with the provision of the holding portion 12*d*, the base portion 15*a* and the stepped portion 16*c* are formed such that they are not disengaged from the notched portion 11*b*.

Here, assume the thickness size from the outer surface of the holding portion 12*d* to the inner surface of the base portion 15*a* of the roller holder 15 as a size L2 (see FIG. 5), this size L2 becomes a relatively large thickness size because of the laminated structure in three layers.

The flexible cable 17 is a strip-like body which is formed by extending a plurality of conductive bodies made of copper (Cu) or the like on one surface of a base film made of an insulation tape, for example. The number of conductive bodies of this strip-like body is set to a given number corresponding to the number of circuits of electric devices to be connected.

The flexible cable 17 has both end portions thereof electrically led out to the outside of the movable-side and fixed-side housings. Further, the flexible cable 17 is placed on the base portion 15*a* of the roller holder 15 such that the flexible cable 17 can be reeled and unreeled.

As mentioned above, in the conventional rotary connector, the portion of the inner peripheral side of the base portion 15*a*, the stepped portion 16*c* and the holding portion 12*d* are sequentially laminated and arranged in three layers such that they face the notched portion lib of the first rotor member 11*b*. Accordingly, the thickness size of this portion becomes large and hence, the thickness of the rotary connector in the axial direction becomes large whereby there has been a problem that it becomes impossible to make the rotary connector thin.

Further, recently, there has been a tendency that the number of circuits of electric devices connected by way of the rotary connector 100 is increased. Further, there has also been a tendency that the size of the flexible case 17 in the widthwise direction becomes physically large corresponding to the increase of the number of the circuits. In the rotary connector 100 which accommodates the flexible cable 17 which has the large size in the widthwise direction, although there has been a tendency that the thickness in the axial direction becomes large, there is a demand for making the rotary connector 100 thin on the other hand.

SUMMARY OF THE INVENTION

The present invention has been made to solve the abovementioned problems, and it is an object of the present invention to provide a rotary connector which can largely increase the height of a space which accommodates a flexible cable without increasing the height of the rotary connector.

To achieve the abovementioned objects, according to the present invention, there is provided a rotary connector comprising a fixed housing having an outer cylindrical body and a bottom plate which is protruded inwardly from an outer periphery of a lower end of the outer cylindrical body, a movable housing being rotatably engaged with the fixed housing and having an inner cylindrical body which forms an accommodating space between the inner cylindrical body and the fixed housing, a top plate formed on at least either one of the housings such that the top plate suppresses the downward movement of the movable housing to the fixed housing, a flexible cable being accommodated in the accommodating space, being wound and being electrically led out to the outside of the fixed housing and the movable housing, and a hollow movable body being rotatably arranged in the accommodating space and having reverse rotation portions which reverse the rotating direction of the flexible cable, wherein a support cylindrical body which has a diameter smaller than an outer diameter of the inner cylindrical body and forms a stepped portion between the support cylindrical body and the inner cylindrical body is integrally connected to the inner cylindrical body at a lower portion of the inner cylindrical body, an engaging portion which is rotatably engaged with the movable body is protruded downwardly from a peripheral portion of a bottom surface of the inner cylindrical body at the stepped portion, an inner peripheral portion of the bottom plate of the fixed housing is bent toward a bottom surface of the inner cylindrical body at a position inside the engaging portion and is extended along the bottom surface of the inner cylindrical body so as to form a bent portion, and a holding portion which rotatably sandwiches the inner peripheral portion of the bottom plate of the fixed housing between the holding portion and the bottom surface of the inner cylindrical body is protruded outwardly from an outer peripheral portion of a lower end of the support cylindrical body.

Due to such a constitution, it becomes possible to provide the rotary connector which can largely increase the height of the space in which the flexible cable is accommodated without increasing the height of the rotary connector.

Further, according to the rotary connector of the present invention, the engaging portion may have a height size approximately equal to a thickness size of the movable body.

Due to such a constitution, the play of the movable body can be easily reduced with a simple constitution.

Further, according to the rotary connector of the present invention, between the inner peripheral portion of the bottom plate of the fixed housing and the bottom surface of the inner cylindrical body of the movable housing as well as between the inner peripheral portion of the bottom plate of the fixed housing and the holding portion of the support cylindrical body, gaps which allow the rotation of the movable housing relative to the fixed housing may be formed.

Due to such a constitution, it becomes possible to rotate the movable housing in a stable state.

Still further, according to the rotary connector of the present invention, the top plate is integrally formed with the inner cylindrical body, a top plate stepped portion is formed on an outer peripheral portion of a bottom surface of the top plate, and an engaging portion which is engaged with the top plate stepped portion is protruded inwardly from the outer cylindrical body of the fixed housing.

Due to such a constitution, the inner cylindrical body and the outer cylindrical body can be surely engaged with each other.

PREFERRED EMBODIMENTS OF THE PRESENT INVENTION

A rotary connector of the present invention is explained in conjunction with attached drawings.

Figure 1:
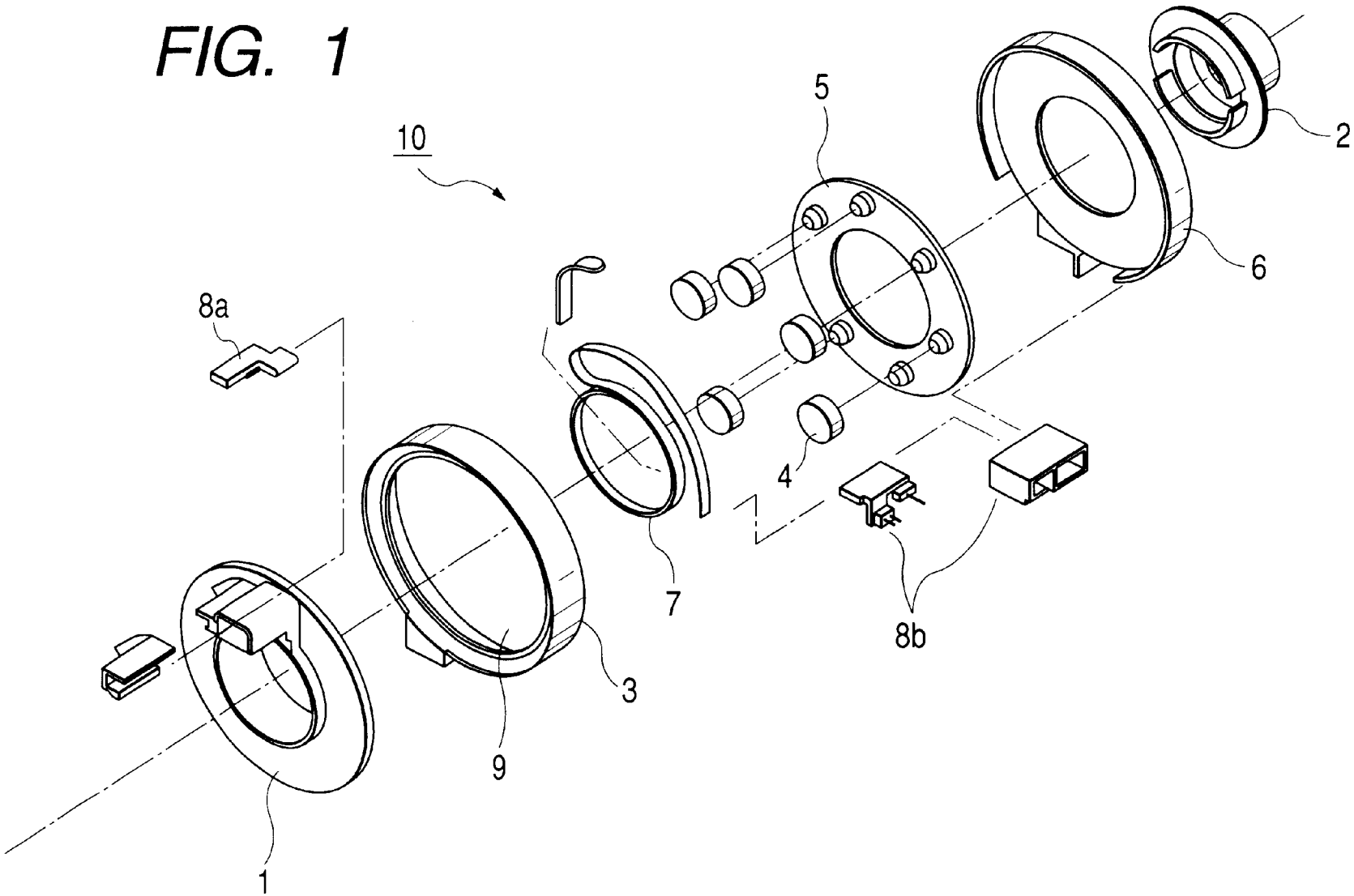
FIG. 1 is an exploded perspective view showing an embodiment of a rotary connector of the present invention.
Figure 2:
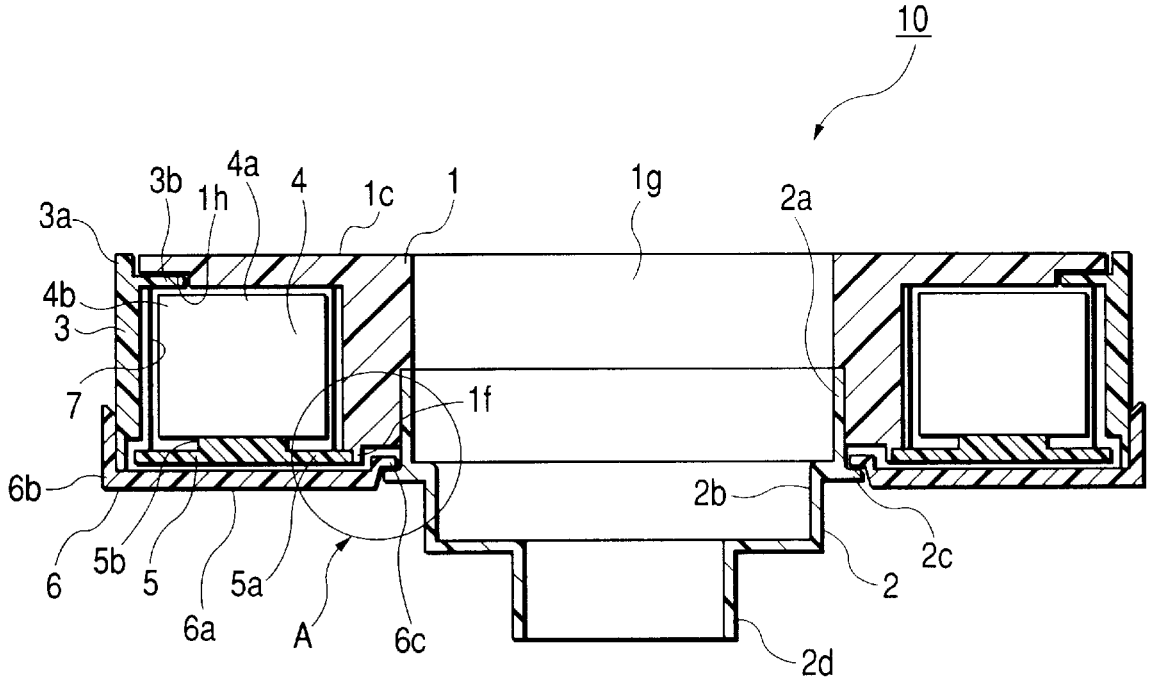
FIG. 2 is a cross-sectional view showing an embodiment of a rotary connector of the present invention.
Figure 3:
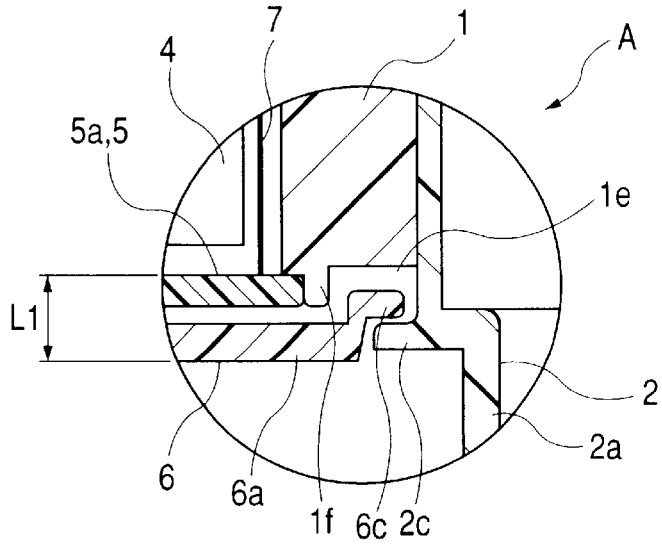
FIG. 3 is an enlarged cross-sectional view of a portion A of FIG. 2.
Figure 4:
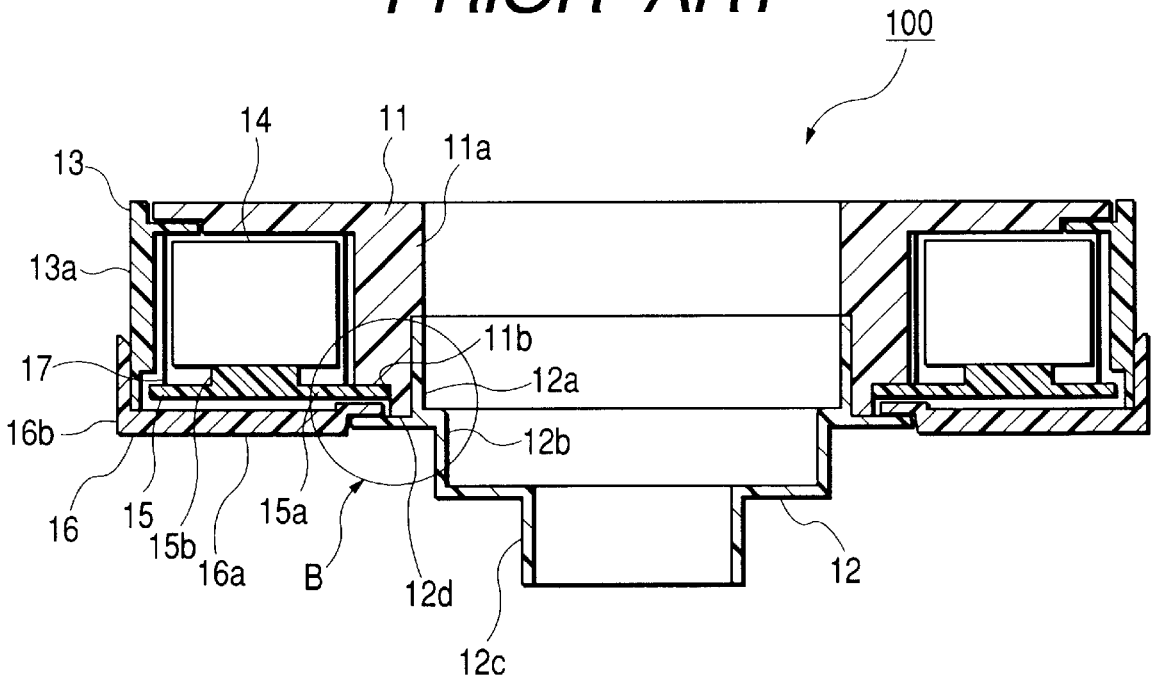
FIG. 4 PRIOR ART
FIG. 4 is a cross-sectional view showing a conventional rotary connector.
Figure 5:
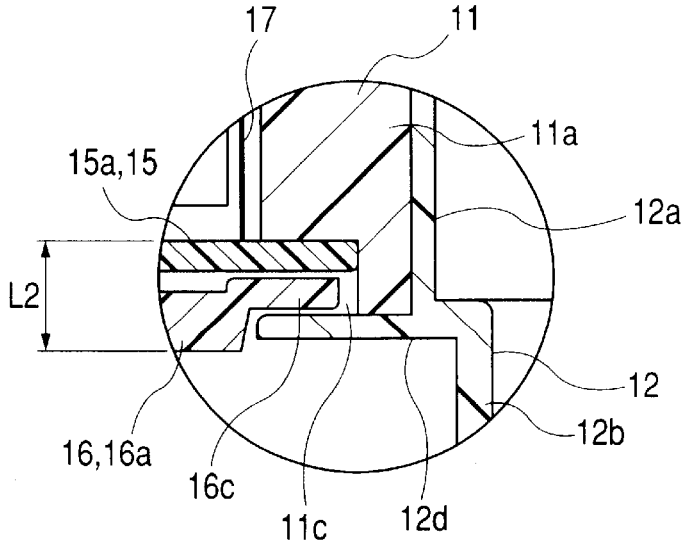
FIG. 5 PRIOR ART
FIG. 5 is an enlarged cross-sectional view of a portion B of FIG. 4.

FIG. 1 is an exploded perspective view showing an embodiment of a rotary connector of the present invention, FIG. 2 is a cross-sectional view showing an embodiment of a rotary connector of the present invention, and FIG. 3 is an enlarged cross-sectional view of a portion A of FIG. 2.

As shown in FIG. 1, this rotary connector 10 is generally comprised of a pair of a first rotor member 1 which constitutes an inner cylindrical body and a second rotor member 2 which constitutes a support cylindrical body which is integrally connected to the first rotor member 1, the first rotor member 1 and the second rotor member 2 being concentrically and rotatably connected, a cable accommodating portion 3 which constitutes an outer cylindrical body, rollers 4, a roller holder 5 which constitutes a control member, a cover 6, and a flexible cable 7 which is accommodated and wound in the inside of an accommodating portion 9 defined among the first and second rotor members 1, 2, the cable accommodating portion 3 and the cover 6 and is brought into contact with the roller holder 5.

The first rotor member 1 and the second rotor member 2 are united to form a movable housing, while the cable accommodating portion 3 and the cover 6 are united to form a fixed housing. Further, they are constituted such that when the movable housing is rotated in the clockwise direction or counter clockwise direction, the winding of the flexible cable 7 in the accommodating portion 9 is tightened or loosened.

The first and the second rotor members 1, 2 which constitute the movable housing of the rotary connector 10 and the cable accommodating portion 3 and the cover 6 which constitute the fixed housing of the rotary connector 10 are engaged with each other in a relatively loose manner and a relatively large clearance is formed in the engaging portion. Due to a play formed between the movable housing and the fixed housing derived from the clearance at this engaging portion, the stability of the rotation of the rotary connector 10 is maintained.

In the rotary connector 10 which has such a general constitution, the fixed housing which is constituted of the cable accommodating portion 3 and the cover 6 is fixedly secured to a car body (not shown in the drawing) and the movable housing which is constituted of the first rotor member 1 and the second rotor member 2 is fixedly secured to a hub (not shown in the drawing) of a steering shaft. Further, by connecting both ends of the flexible cable 7 to respective electric devices at the car body and the steering wheel side through respective connectors 8*a*, 8*b*, the rotary connector 10 can be used as an electric connecting means for an airbag system, a horn circuit and the like which are mounted on a vehicle.

As shown in FIG. 2 and FIG. 3, the first rotor member 1, for example, is made of a synthetic resin material and is formed by molding. A central hole 1*g* is formed in the first rotor member 1 and an annular flange portion 1*c* which constitutes a top plate and is protruded radially outwardly from a distal end portion of the first rotor member 1 is formed on the first rotor member 1. Further, on an outer peripheral portion of a bottom surface of the flange portion 1*c*, a top-plate stepped portion 1*h* is formed. Below the first rotor member 1, the second rotor member 2 which has a diameter smaller than a diameter of the first rotor member 1 is integrally connected to the first rotor member 1 such that a stepped portion 1*e* is formed between the first rotor member 1 and the second rotor member 2.

The second rotor member 2 is, for example, made of a synthetic resin material and is formed by molding. The second rotor member 2 includes an approximately cylindrical large-diameter cylindrical portion 2*a* which forms the central hole 1*g* together with the inner peripheral surface of the first rotor member 1, an intermediate-diameter cylindrical portion 2*b* which is contiguously connected to the large-diameter cylindrical portion 2*a*, a small-diameter cylindrical portion 2*d* which is contiguously connected to the intermediate-diameter cylindrical portion 2*b*, and an annular holding portion 2*c* which is formed such that the holding portion 2*c* is extended perpendicularly in the radial direction from the lower end of the large-diameter cylindrical portion 2*a* that is a joining portion between the large-diameter cylindrical portion 2*a* and the intermediate-diameter cylindrical portion 2*b*. Then, at a stepped portion formed by connecting the first rotor member 1 and the second rotor member 2, an annular engaging portion 1*f* is formed on a peripheral portion of a bottom surface of the first rotor member 1 such that the engaging portion if is protruded downwardly. Here, the distal end portion of the holding portion 2*c* is positioned in the inside of the engaging portion if in the radial direction of the rotor member.

This second rotor member 2 is made to pass through the central hole 1*g* of the first rotor member 1 and is engaged with the first rotor member 1 by a suitable means such as a snap-in joint, for example, so that the second rotor member 2 and the first rotor member 1 are united to form the movable housing. Then, the holding portion 2*c* of the second rotor member 2 is arranged such that a portion of the stepped portion 1*e* is closed by an upper surface of the holding portion 2*c*.

The cable accommodating portion 3 is, for example, made of synthetic resin material and is formed by molding. The cable accommodating portion 3 includes an annular side wall 3*a* and an annular intermediate holding portion 3*b* which is protruded inwardly from an approximately intermediate portion of the side wall 3*a* and has both end portions thereof opened. On an outer surface of the intermediate holding portion 3*b* of this cable accommodating portion 3, a top-plate stepped portion 1*h* which is formed on an outer peripheral end portion of the flange portion 1*c* of the first rotor member 1 is placed.

The rollers 4 are, for example, made of a synthetic resin material and are formed by molding. Each roller 4 includes an approximately circular upper wall 4*a* and a cylindrical side wall 4*b* which is formed such that side wall 4*b* is extended perpendicularly from an outer peripheral portion of the upper wall 4*a*.

The roller holder 5 which constitutes a movable body is, for example, made of synthetic resin material and is formed by molding. The roller holder 5 includes a planar and approximately annular base portion 5*a* and a plurality of roller supporting portions 5*b* which are protruded perpendicularly and outwardly from the base portion 5*a*. In the inside of the cable accommodating portion 3, this roller holder 5 is accommodated in the accommodating portion 9 (see FIG. 1) which is formed by the movable housing and the fixed housing. Further, a portion of the inner peripheral side of the base portion 5*a* of the roller holder 5 is rotatably engaged with the engaging portion if at the stepped portion formed in the joint portion of the first rotor member 1 and the second rotor member 2. That is, the roller holder 5 is arranged such that the roller holder 5 is not moved toward the upper side of the first rotor member 1, that is, toward the flange portion 1*c* side.

The rollers 4 are rotatably mounted on the roller supporting portions 5*b* of the roller holder 5 by suitable means such as snap-in joints.

The roller holder 5 is configured to control the movement of the flexible cable 7 and to make the rotational operation thereof different from the rotation of the movable housing.

Here, although the roller holder 5 which is provided with the rollers 4 is explained as a movable body, the holder 5 may not be provided with rollers.

The cover (bottom plate) 6 is, for example, made of a synthetic resin material and is formed by molding. The cover 6 includes a left wall portion 6*a* which is formed in an annular and planar shape, a side wall 6*b* which is formed perpendicularly from an outer peripheral portion of the left wall portion 6*a*, and a bent portion 6*c* which is protruded and bent in an L-shaped cross section inwardly from an inner peripheral portion of the left wall portion 6*a*. Further, the side wall 3*a* of the cable accommodating portion 3 is engaged with the side wall 6*b* of the cover 6 by a suitable means such as a snap-in joint, for example, so that the cable accommodating portion 3 and the cover 6 are united to form the fixed housing.

Further, the bent portion 6*c* of the cover 6 is positioned at the inside of the rotor member in the radial direction with respect to the engaging portion If. Further, in the inside of the stepped portion 1*e* which is formed at a connecting portion between the first rotor member 1 and the second rotor member 2, a distal end portion of the bent portion 6*c* is arranged such that the distal end portion is extended along a bottom surface of the first rotor member 1, while the distal end portion of the bent portion 6*c* is arranged such that the distal end portion is sandwiched between the bottom surface of the first rotor member 1 and the holding portion 2*c* of the second rotor member 2.

Accordingly, this bent portion 6*c* and the holding portion 2*c* are arranged in the inside of the stepped portion 1*e* such that only the bent portion 6*c* and the holding portion 2*c* are laminated in an overlapped manner. Due to such a constitution, the fixed housing is arranged such that it is latched by the movable housing. On the other hand, the bottom wall portion 6*a* is positioned radially outwardly from these rotor members with respect to the engaging portion if such that the bottom wall portion 6*a* overlaps the base portion 5*a*.

That is, an overlapped portion between the bent portion 6*c* and the holding portion 2*c* and an overlapped portion between the bottom wall portion 6*a* and the base portion 5*a* are arranged such that they are displaced in the radial direction of the movable housing. Accordingly, compared to a conventional example of a rotary connector which laminates the base portion 5*a*, a stepped portion 16*c* and a support portion 12*d*, the rotary connector of the present invention can largely increase the height of the cable accommodating portion 3.

Then, an inner surface of the stepped portion 6*c* and an inner surface of the base portion 5*a* of the roller holder 5 are arranged such that they become approximately coplanar. The flexible cable 7 is brought into contact with the inner surface of the base portion 5*a*.

Further, an outer surface of the wall portion 6*a* and an outer surface of the holding portion 2*c* of the second rotor member 2 are arranged such that they become approximately coplanar.

Here, assume the thickness size from the outer surface of the wall portion 6*a* of the cover 6 to the inner surface of the base portion 5*a* of the roller holder 5 as a size L1, this size L1 is made thin compared with the size L2 of the conventional connector to satisfy L1<L2.

Accordingly, without increasing the size of the rotary connector in the height direction, the present invention can set the size of the accommodating portion 9 in the height direction at a large value and hence, the width of the flexible cable 7 can be increased.

The flexible cable 7 is, for example, a strip-like body which is formed by extending a plurality of conductive bodies made of copper (Cu) or the like on one surface of a base film made of an insulation tape. The number of conductive bodies of this strip-like body is determined to a given number corresponding to the number of circuits of an electric device to be connected. That is, corresponding to the increase of the number of circuits of the electric device, the number of the conductive bodies is increased and hence, the width size of the strip-like body is increased.

The flexible cable 7 has both end portions thereof respectively electrically led out to the outside of the movable-side housing and the outside of the fixed-side housing. Further, the flexible cable 7 is placed on the inner surface of the base portion 5*a* of the roller holder 5 and is reeled or unreeled corresponding to the rotation of the movable housing. That is, the flexible cable 7 is accommodated in the accommodating portion 9 defined between the fixed housing and the movable housing.

In the abovementioned embodiment, although the flange portion 1*c* is integrally formed with the first rotor member 1, the present invention is not limited to such a constitution and the flange portion may be formed on the cable accommodating portion 3.

As has been described heretofore, according to the rotary connector of the present invention, a support cylindrical body which has a diameter smaller than an outer diameter of the inner cylindrical body and forms a stepped portion between the support cylindrical body and the inner cylindrical body is integrally connected to a lower portion of the inner cylindrical body, an engaging portion which is rotatably engaged with the disc-like movable body is protruded downwardly from a peripheral portion of a bottom surface of the inner cylindrical body at the stepped portion, an inner peripheral portion of the bottom plate of the fixed housing is bent toward a bottom surface of the inner cylindrical body at a position inside the engaging portion and is extended along the bottom surface of the inner cylindrical body so as to form a bent portion, and a holding portion which rotatably sandwiches the inner peripheral portion of the bottom plate of the fixed housing between the holding portion and the bottom surface of the inner cylindrical body is protruded outwardly from an outer peripheral portion of a lower end of the support cylindrical body. Accordingly, compared with the conventionally manufactured rotary connector, the present invention can achieve an advantageous effect that it becomes possible to provide the rotary connector which can increase the height of the space in which the flexible cable is accommodated without increasing the height of the rotary connector.

What is claimed is:

1. A rotary connector comprising:

a fixed housing having an outer cylindrical body and a bottom plate which is protruded inwardly from an outer periphery of a lower end of the outer cylindrical body;

a movable housing being rotatably engaged with the fixed housing and having an inner cylindrical body, an accommodating space formed between the inner cylindrical body and the fixed housing;

a top plate formed on at least either one of the housings such that the top plate suppresses a downward movement of the movable housing to the fixed housing, a flexible cable being accommodated in the accommodating space, being wound and being electrically led out to the outside of the fixed housing and the movable housing; and a hollow movable body being rotatably arranged in the accommodating space and having reverse rotation portions which reverse a rotating direction of the flexible cable, wherein a support cylindrical body which has an outer diameter smaller than an outer diameter of the inner cylindrical body and forms a stepped portion between an outer surface of the support cylindrical body and an outer surface of the inner cylindrical body is integrally connected to the inner cylindrical body at a lower portion of the inner cylindrical body, a first engaging portion which is rotatably engaged with an annular base portion of the movable body is protruded downwardly from a peripheral portion of a bottom surface of the inner cylindrical body at the stepped portion, an inner peripheral portion of the bottom plate of the fixed housing is bent toward the bottom surface of the inner cylindrical body and is bent towards the outer diameter of the support cylindrical body at a position more proximate to the outer diameter of the support cylindrical body than the first engaging portion, a portion of the inner peripheral portion of the bottom plate bent towards the outer diameter of the support cylindrical body forming a bent portion in the stepped portion, and a holding portion which rotatably sandwiches the bent portion of the bottom plate of the fixed housing between the holding portion and the bottom surface of the inner cylindrical body is protruded outwardly from an outer peripheral portion of a lower end of the support cylindrical body.

2. A rotary connector according to claim 1, wherein the first engaging portion has a height size approximately equal to a thickness size of the annular base portion of the movable body.

3. A rotary connector according to claim 1, wherein between the inner peripheral portion of the bottom plate of the fixed housing and the bottom surface of the inner cylindrical body of the movable housing as well as between the inner peripheral portion of the bottom plate of the fixed housing and the holding portion of the support cylindrical body, gaps which allow the rotation of the annular base portion of the movable housing relative to the fixed housing are formed.

4. A rotary connector according to claim 1, wherein the top plate is integrally formed with the inner cylindrical body, a top plate stepped portion is formed on an outer peripheral portion of a bottom surface of the top plate, and a second engaging portion which is engaged with the top plate stepped portion is protruded inwardly from the outer cylindrical body of the fixed housing.

5. A rotary connector according to claim 1, wherein the bent portion intersects a plane extending from the annular base portion of the movable body towards the outer diameter of the support cylindrical body.

6. A rotary connector according to claim 1, wherein the annual base portion has a roller supporting portion and the movable body further includes a roller rotatably arranged at the roller supporting portion.

7. A rotary connector according to claim 5, wherein the first engaging portion has a height size approximately equal to a thickness size of the annular base portion of the movable body.

8. A rotary connector according to claim 5, wherein between the inner peripheral portion of the bottom plate of the fixed housing and the bottom surface of the inner cylindrical body of the movable housing as well as between the inner peripheral portion of the bottom plate of the fixed housing and the holding portion of the support cylindrical body, gaps which allow the rotation of the annular base portion of the movable housing relative to the fixed housing are formed.

9. A rotary connector according to claim 5, wherein the top plate is integrally formed with the inner cylindrical body, a top plate stepped portion is formed on an outer peripheral portion of a bottom surface of the top plate, and a second engaging portion which is engaged with the top plate stepped portion is protruded inwardly from the outer cylindrical body of the fixed housing.

10. A rotary connector according to claim 5, wherein the bent portion intersects a plane extending from the annular base portion of the movable body towards the outer diameter of the support cylindrical body.

* * * * *